US008375482B1

(12) United States Patent
Owens

(10) Patent No.: US 8,375,482 B1
(45) Date of Patent: Feb. 19, 2013

(54) FOLDABLE MATTRESS WITH REMOVABLE PILLOW TOP

(75) Inventor: W. Neil Owens, Denton, NC (US)

(73) Assignee: Axess Direct, Inc., Asheboro, NC (US)

( * ) Notice: Subject to any disclaimer, the term of this patent is extended or adjusted under 35 U.S.C. 154(b) by 208 days.

(21) Appl. No.: 12/957,583

(22) Filed: Dec. 1, 2010

(51) Int. Cl.
*A47C 17/04* (2006.01)
*A47C 27/00* (2006.01)

(52) U.S. Cl. ..... 5/12.1; 5/691; 5/723

(58) Field of Classification Search ..... 5/12.1, 5/691, 722, 723, 657
See application file for complete search history.

(56) References Cited

U.S. PATENT DOCUMENTS

| | | | | |
|---|---|---|---|---|
| 4,768,253 | A | 9/1988 | Boyd et al. | 5/464 |
| 4,930,170 | A * | 6/1990 | Kobayashi | 5/12.1 |
| 7,124,457 | B2 | 10/2006 | Metzger | 5/706 |
| D622,996 | S | 9/2010 | Morrison et al. | D6/596 |

* cited by examiner

*Primary Examiner* — Robert G Santos
(74) *Attorney, Agent, or Firm* — Blake P. Hurt

(57) ABSTRACT

A foldable mattress and removable pillow top with a means for releasable attachment is not damaged during excessive folding such as when used in a sofa bed. Fastening pairs comprising zippers affixed to the mattress and pillow top in opposing complementary fashion with a wide fold space defined therebetween allow the mattress and attached pillow top to be repeatedly folded and unfolded and avoid crimping and damage to the zipper halves, mattress and attached pillow top.

16 Claims, 5 Drawing Sheets

FOLDABLE MATTRESS WITH REMOVABLE PILLOW TOP

FIELD OF THE INVENTION

The invention herein pertains to foldable mattresses and particularly pertains to foldable mattresses utilizing removable pillow tops such as provided in sofa and other beds.

DESCRIPTION OF THE PRIOR ART AND OBJECTIVES OF THE INVENTION

In recent years sofa beds and other foldable type furniture have employed mattresses having releasable pillow tops. Pillow top mattresses are becoming more desirable and provide additional comfort for the user. While these devices provide great convenience and may be durable when seldom used, frequent repeated usage such as in studio apartments, hotels, motels and the like impact the means used in attaching the pillow top to the mattress, often causing the attaching means to fail, making it difficult for owners and maintenance personnel to remove the pillow tops for cleaning or replacement purposes.

Oftentimes repeated folding and unfolding of the pillow top mattress crimps, bends, breaks and otherwise damages the zipper or other fastening structure used also causing possible damage to the pillow top mattress. Accordingly, the pillow top will become unstable requiring the owner or manager to repair or replace the mattress and pillow top in its entirety.

Thus with the problems and disadvantages of mattresses with pillow tops as are used in foldable beds, cots and the like, the present invention was conceived and one of its objectives is to provide a reliable means for releasably attaching a foldable pillow top to a foldable mattress which is economical, durable under repeated use conditions and relatively inexpensive.

It is another objective of the present invention to provide a method of easily releasably attaching a foldable pillow top to a foldable mattress without special tools or training.

It is still another objective of the present invention to provide a foldable mattress and removable pillow top with opposing pairs of complementary U-shaped fastener halves which are spaced apart along the mattress fold line to avoid crimping and damaging the fastener halves and the mattress and pillow top when they are folded such as during periods of non-use.

It is yet another objective of the present invention to provide a method of forming a foldable mattress and removable pillow top combination for a sofa bed in which the pillow top can be easily attached to the mattress using zippers and later removed and replaced as needed for cleaning or storage.

It is yet a further objective of the present invention to provide a foldable mattress and removable pillow top in which the fastener halves are inset from the edges of the mattress and pillow top so the fastener halves are not felt during use and to prevent wear such as may occur if the fastener halves were positioned along the outer edges of the mattress and pillow top.

Various other objectives and advantages of the present invention will become apparent to those skilled in the art as a more detailed description is set forth below.

SUMMARY OF THE INVENTION

The aforesaid and other objectives are realized by providing a foldable mattress for use in sofa beds, and other foldable beds such as cots or the like having a releasable foldable pillow top attached to the top surface of the mattress utilizing two pair of fastener halves formed from zippers. The zipper halves are U-shaped and arranged in complementary opposing relation to define or form an adequately wide fold space therebetween to accommodate sharp bending or folding of the mattress and pillow top. The U-shaped zipper halves proximate the head end of the mattress and pillow top are longer then the U-shaped zipper halves proximate the foot end of the bed to accommodate for folding of the mattress and pillow top. The fold spaces in the mattress and the pillow top are in coincidental contact when the mattress and pillow top are fastened together. As mattresses in sofa beds are generally folded at an acute angle a sufficient wide space is provided between the zipper halves or other fasteners to prevent damage to the means of attachment and to the mattress and pillow top. This fold space removes pressure from the fasteners when folded and allows the mattress and pillow top to be repeatedly folded and unfolded without damage to the mattress and pillow top or fasteners. As needed, the pillow top can be easily, manually released for cleaning and replaced on the mattress or replacement of a new pillow top if needed without the use of tools or special instruments.

DETAILED DESCRIPTION OF THE PREFERRED EMBODIMENT AND OPERATION OF THE INVENTION

Figure 1:
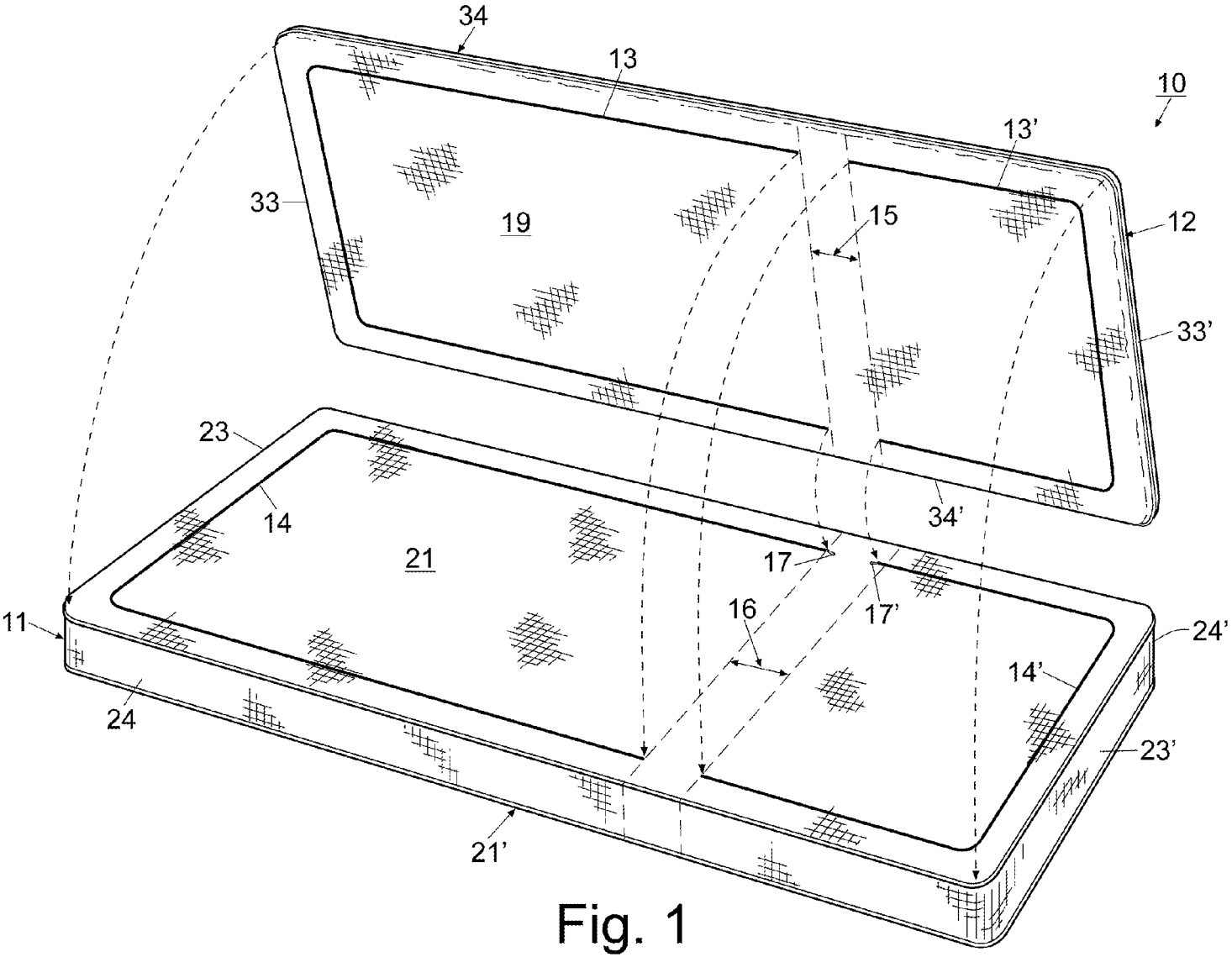
FIG. 1 shows a mattress and pillow top of the invention prior to assembly.
Figure 2:
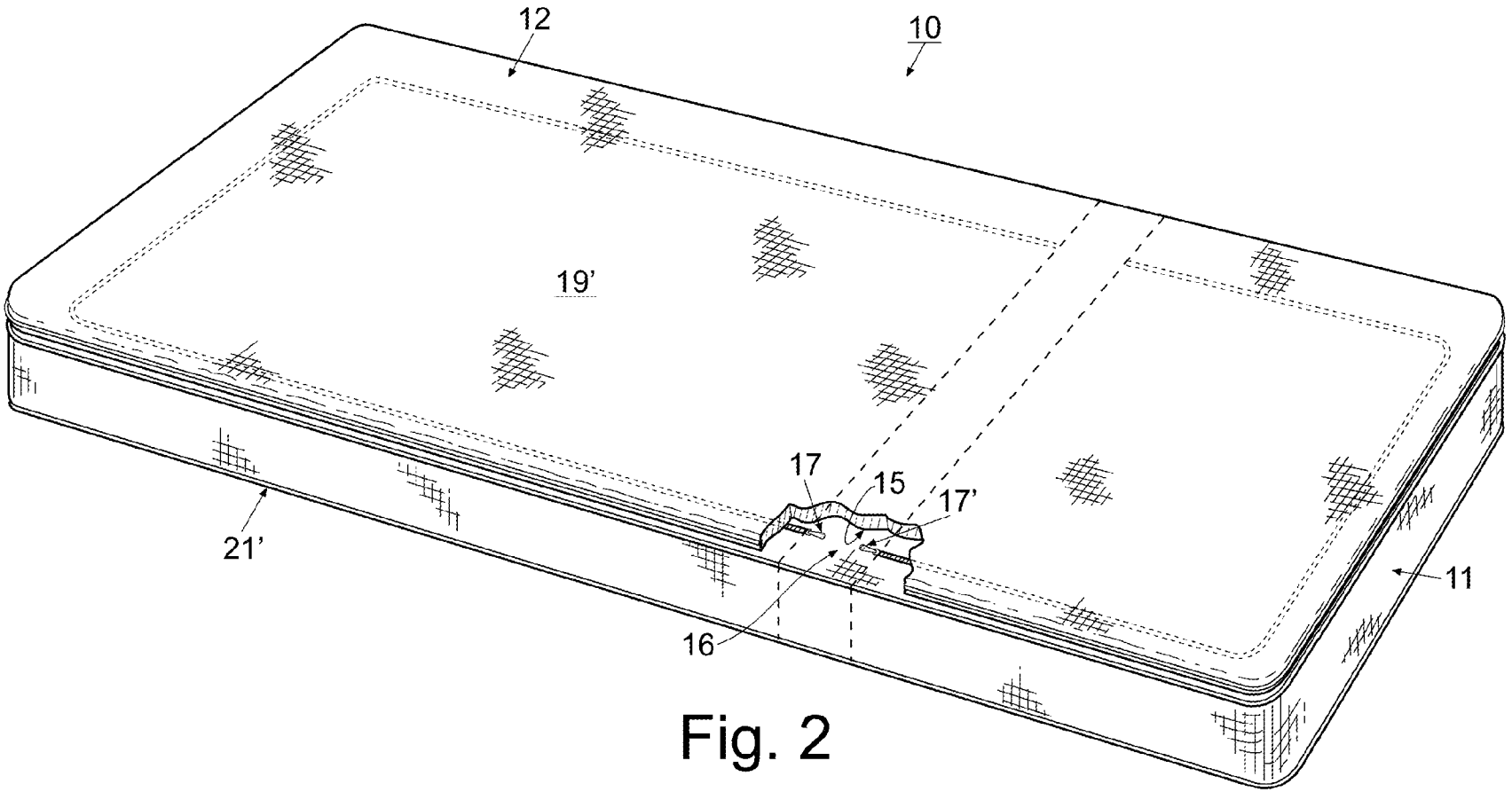
FIG. 2 shows the mattress and pillow top of FIG. 1 in assembled fashion with a partial section cut-away.
Figure 4:
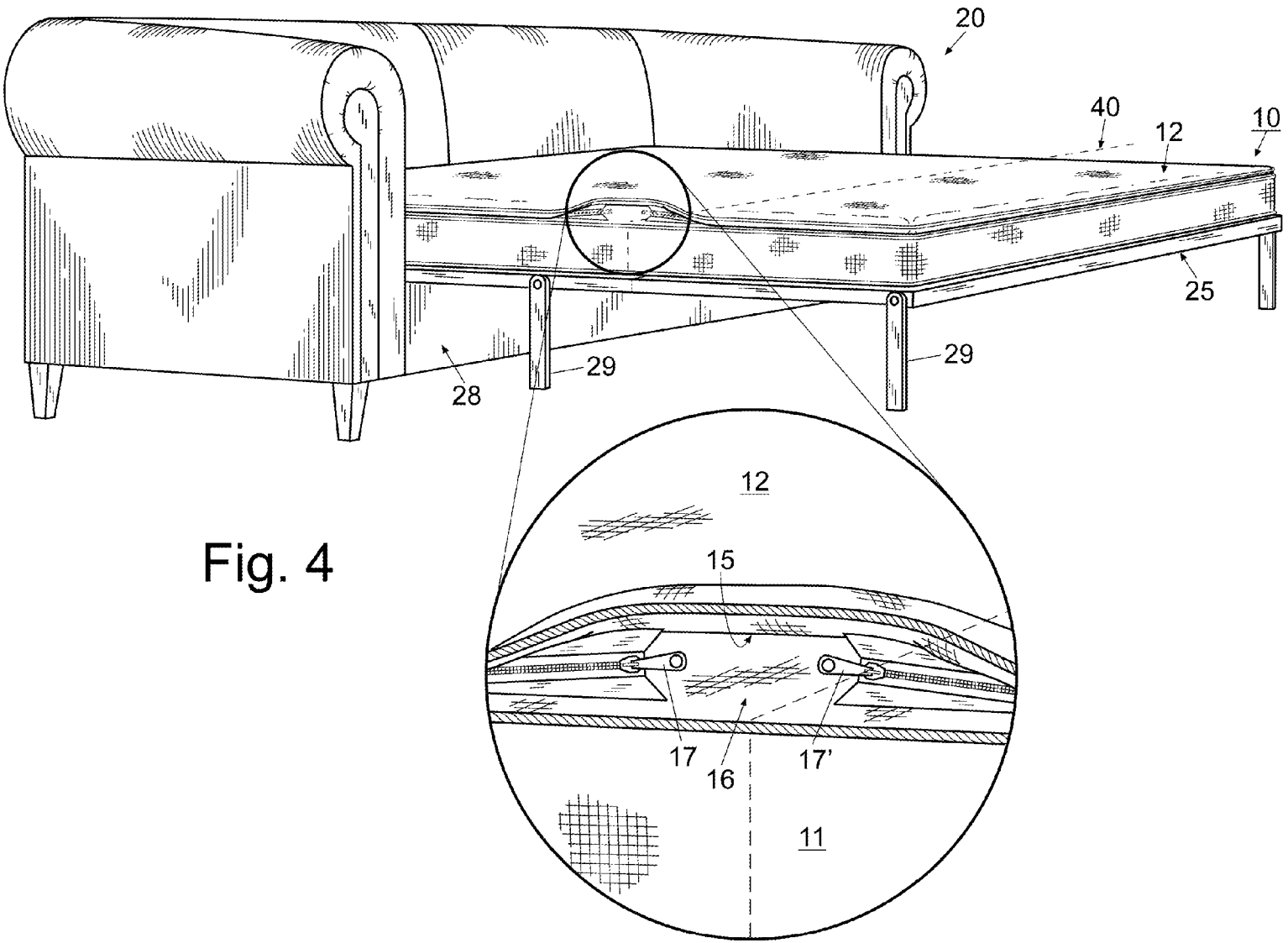
FIG. 4 shows the mattress and pillow top in the sofa bed as seen in FIG. 3 but in an unfolded posture or bed mode with an enlarged area.

For a better understanding of the invention and its method of operation, turning now to the drawings, FIG. 1 shows preferred mattress and pillow top combination 10 with mattress and pillow top 12 prior to assembly having a means for releasably affixing or fastening pillow top 12 to mattress 11. The preferred fastening means consists of a pair of U-shaped zipper halves 13, 13' inset about 3.5 inches (8.89 cm) from the edges and attached to bottom surface 19 of pillow top 12 and a complementary pair of U-shaped zipper halves 14, 14' inset about 3.5 inches (8.89 cm) from the edges and attached to top surface 21 of mattress 11. As seen in FIG. 1 wide fold spaces 15, 16 of preferably about six inches (15.24 cm) are provided between respectively zipper halves 13, 13' and zipper halves 14, 14' to allow for folding (seen schematically in FIG. 5) of respectively pillow top 12 and mattress 11 without undue pressure applied to joined zipper halves 13, 14 and 13', 14'. Other spacing dimensions between the zipper fastener means may be used to accommodate different mattress sizes, thicknesses and configurations, with the preferred spacings being at least about the thickness of the particular mattress used. Zipper half 14 of mattress 11 includes conventional zipper pull 17 for engagement with zipper half 13 of pillow top 12 and zipper half 14' includes conventional zipper pull 17' for engagement with zipper half 13'. By placing pillow top bottom surface 19 on mattress top surface 21, zipper halves 13 and 14 can be manually engaged and meshed by zipper pull 17 and zipper halves 13', 14' can be manually engaged and meshed by zipper pull 17' as seen in assembled mattress and pillow top combination 10 in FIG. 2. Mattress bottom surface 21' is placed against foldable bed frame 25 of sofa bed 20 as seen in FIG. 4. When complementary zipper halves 13, 14 and 13', 14' are engaged, fold space 15 on pillow top bottom surface 19 is in contact with and is coincidental with fold space 16 on mattress top surface 21 as seen in FIGS. 2 and 4. Other types of standard fasteners other than zippers could also be used such as buttons, snaps, plastic slides and rails, but such are not preferred.

Figure 3:
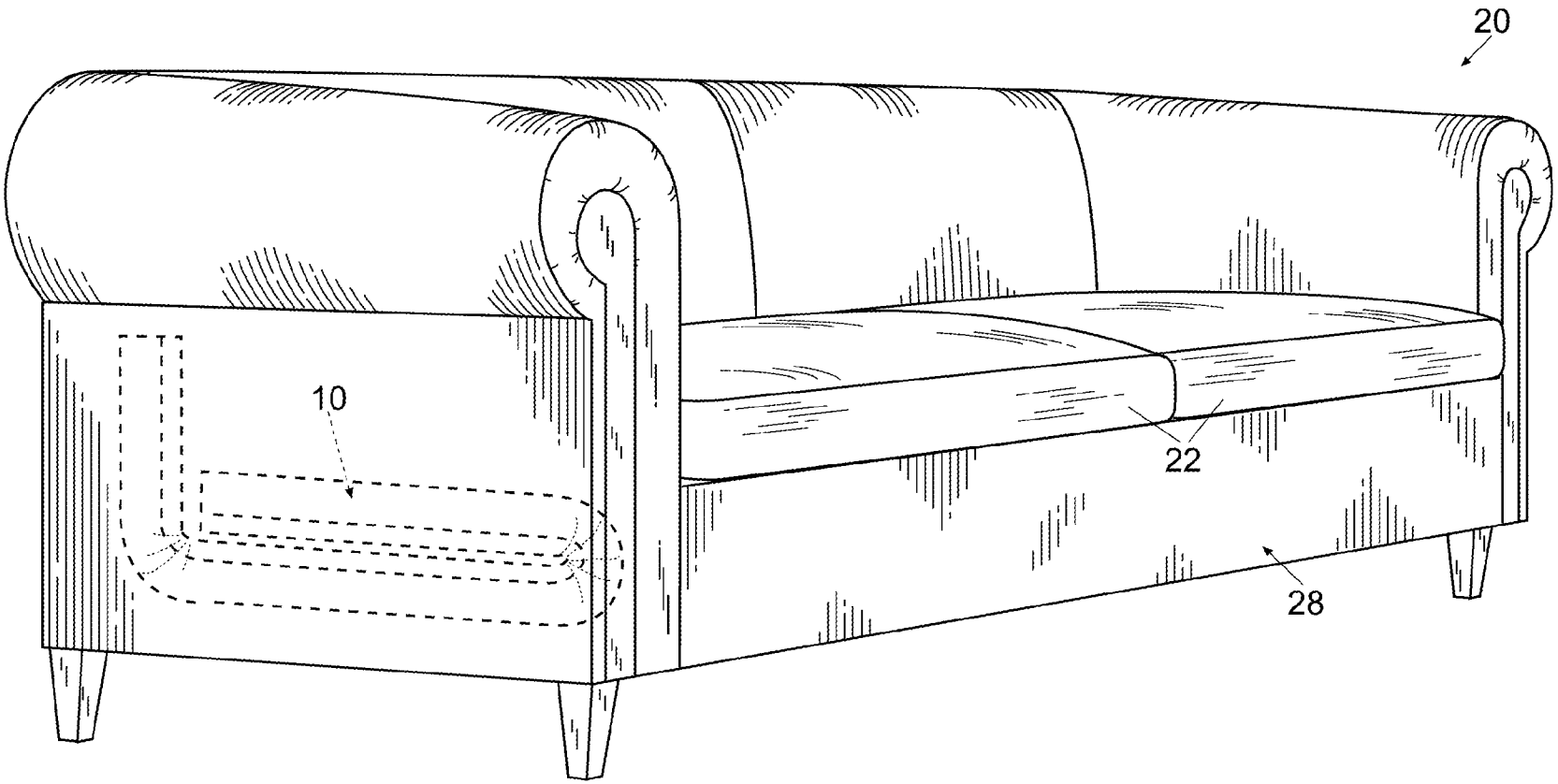
FIG. 3 demonstrates a sofa bed employing a hidden, folded mattress and pillow top as seen in FIG. 2.
Figure 5:
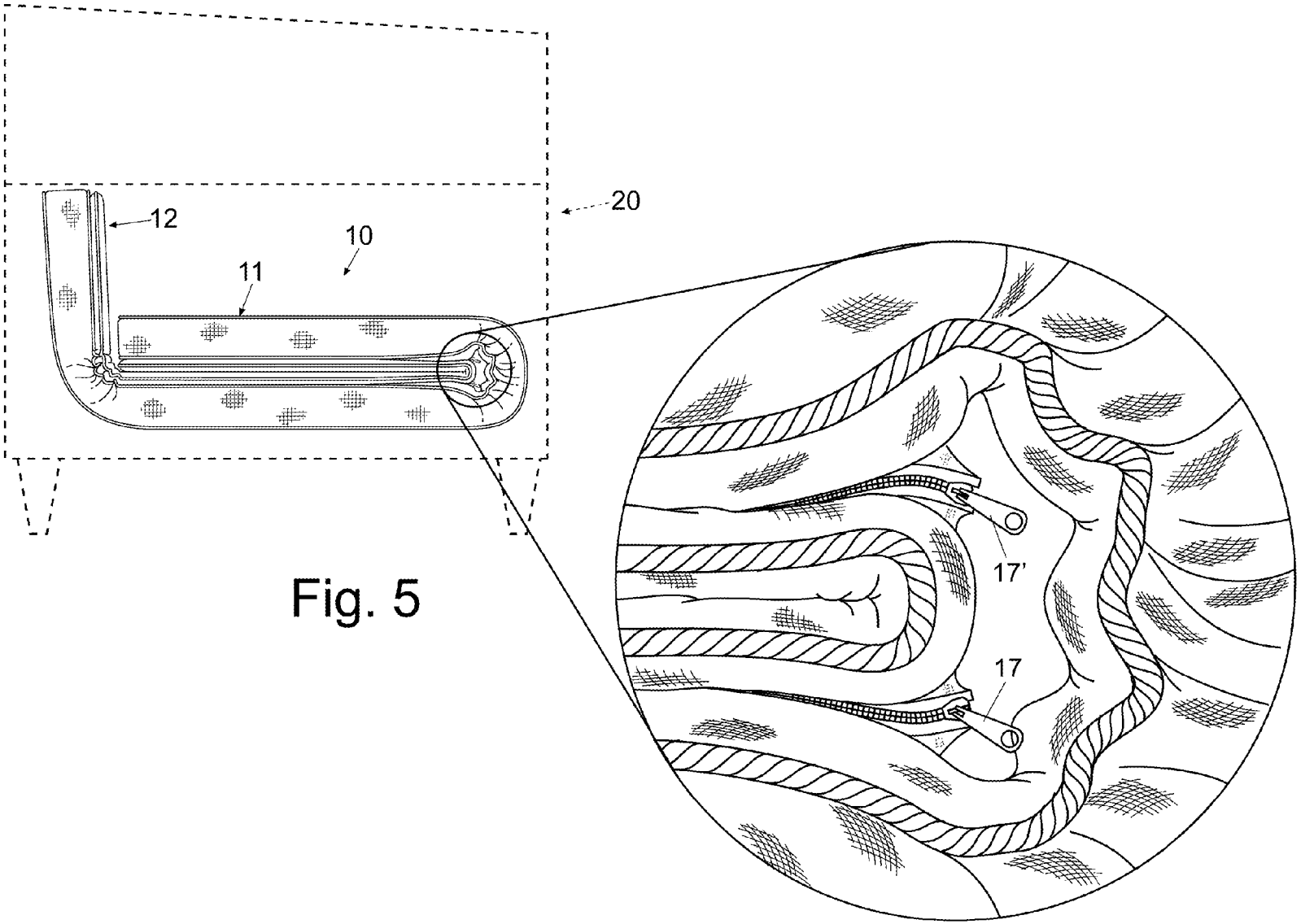
FIG. 5 pictures a partial side view of the mattress and pillow top as seen folded in FIG. 3 with an enlarged area.

Mattress and pillow top combination 10 employs a foldable mattress 11 as used in cots or sofa beds such as sofa bed 20 shown in FIGS. 3, 4 and 5 and foldable releasably attached pillow top 12. Mattress 11 as seen in FIGS. 1 and 2 includes top surface 21, bottom surface 21', head end 23, foot end 23', left side 24, right side 24' and U-shaped zipper halves 14, 14' with wide fold space 16 therebetween. Pillow top 12 as seen in FIGS. 1 and 2 includes top surface 19', bottom surface 19, head end 33, foot end 33', left side 34, right side 34' and U-shaped zipper halves 13, 13' with wide fold space 15 therebetween. As seen U-shaped zipper halves 13, 13', 14 and 14' are inset and spaced from the outer edges of respectively bottom surface 19 of pillow top 12 and top surface 21 of mattress 11 to provide comfort for the user and prevent damage thereto as the fasteners are not on the edge and will not be felt when mattress and pillow top combination 10 is in use. Further edge placement of U-shaped zipper halves 13, 13', 14 and 14' would allow for frictional wear and tear to the fastener halves and mattress and pillow top combination 10 and such is not preferred. In FIG. 3, sofa bed 20 is shown in the sofa mode with mattress and pillow top combination 10 shown folded and concealed within storage base 28 below seat cushions 22. In FIG. 4, sofa bed 20 is shown in the bed mode with seat cushions 22 removed and mattress and pillow top combination 10 unfolded and fully extended, ready for use. Sofa bed 20 includes usual foldable metal frame 25 shown in FIG. 4 as conventionally made of steel, aluminum or the like with pivotable legs 29 for maintaining, storing and supporting mattress and pillow top combination 10. Mattress and pillow top combination 10 shown extended in FIG. 4 is placed on foldable frame 25 and may be affixed thereto mechanically as usual. Frame 25 and mattress and pillow top combination 10 can then be manually folded as schematically depicted in FIG. 4 along fold line 40 into a compact hidden position within storage base 28 as shown in the sofa mode in FIGS. 3 and 5 as usual in the trade. Mattress 11 and pillow top 12 fold substantially along respectively wide fold spaces 16, 15 as hereinbefore described for periods of non-use.

In order to prevent crimping and damage to a zipper or fastener, wide fold spaces 15, 16 are formed between respectively zipper halves 13, 13' of pillow top 12 and zipper halves 14, 14' of mattress 11 as seen in FIG. 1. Thus, a sharp fold as seen in FIG. 5 formed in mattress and pillow top combination 10 on frame 25, when in the sofa mode as shown in FIG. 3, does not damage zipper halves 13, 13', 14 and 14' or zipper pulls 17, 17' and allows such to function normally. Without spacing (of about the thickness of the mattress and pillow top combination 10) between zipper halves 13, 13', 14 and 14', said zipper halves when joined by zipper pulls 17, 17' would generally suffer severe impact and damage due to the bending and pressure of repeated folding and unfolding, causing the zipper halves to malfunction, jam, separate or break and possibly cause damage such as rips or tears to mattress 11 and pillow top 12. As further seen, U-shaped zipper halves 13, 14 are longer than U-shaped zipper halves 13', 14' as zipper halves 13', 14' are positioned proximate respectively foot end 33' of pillow top 12 and foot end 23' of mattress 11 for working in conjunction with the folding along fold spaces 15, 16 of mattress and pillow top combination 10 with frame 25 of sofa bed 20. Longer U-shaped zipper halves 13, 14 are positioned proximate respectively head end 33 of pillow top 12 and head end 23 of mattress 11.

Pillow top 12 of conventional construction is preferably one to two inches (2.54-5.08 cm) in thickness and can be easily removed from mattress 11 which is preferably five to six inches (12.7-15.24 cm) in thickness for cleaning or replacement purposes simply by unzipping U-shaped zipper 13 from complementary U-shaped zipper 14 and U-shaped zipper 13' from complementary U-shaped zipper 14' by manipulating respectively standard zipper pulls 17, 17' as shown in FIGS. 1, 2, 4 and 5.

The method of forming foldable mattress and pillow top combination 10 for use as shown in a sofa bed or the like consists of first providing a foldable mattress such as mattress 11 and affixing to top surface 21 a U-shaped fastener such as elongated U-shaped zipper half 14 with zipper pull 17 proximate head end 23 and inset from the edges thereof as seen in FIG. 1. Next, a second shorter U-shaped fastener such as zipper half 14' with zipper pull 17' is affixed to top surface 21 of mattress 11 proximate foot end 23' and inset from the edges thereof and spacing U-shaped zipper half 14' from U-shaped zipper half 14 by wide space 16 which is approximately six inches (15.24 cm) wide. Next, a pillow top is selected such as pillow top 12 and a complementary fastener such as elongated U-shaped zipper half 13 shown in FIG. 1 is affixed to bottom surface 19 proximate head end 33 of pillow top 12 and inset from the edges thereof. An adequate wide space 15 is provided as hereinbefore described (approximately six inches (15.24 cm) wide) and a second shorter fastener such as U-shaped zipper half 13' is affixed to bottom surface 19 of pillow top 12 proximate foot end 33' and inset from the edges thereof. Next, bottom surface 19 of pillow top is positioned overtop top surface 21 of mattress 11 and zipper pull 17 of zipper half 14 is engaged with zipper half 13 at one end and is manipulated to engage and fully mesh U-shaped zipper halves 13 and 14 as is conventional. Likewise zipper pull 17' of zipper half 14' is engaged with zipper half 13' on pillow top 12 and is manipulated to engage and fully mesh zipper halves 14' and 13'. With mattress 11 and pillow top 12 so engaged assembled mattress and pillow top combination 10 is ready for use and can then be placed in a standard sofa bed such as sofa bed 20 shown in FIG. 3. Mattress and pillow top combination 10 along with usual foldable frame 25 can be folded as conventional into storage base 28 of sofa bed 20 for concealment and convenience and covered with seat cushions 22 or the like for use as a sofa. The wide fold spaces 15, 16 between respectively zipper halves 13, 13' and 14, 14' allows for easy folding of mattress and pillow top combination 10 without applying undue pressure to respectively joined zipper halves 13, 14 and 13', 14' or zipper pulls 17, 17' to allow for repeated use without damage to the fasteners used or to mattress and pillow top combination 10. The wide fold spaces 15, 16 are preferably in width approximately the thickness of mattress and pillow top combination 10, but could be wider if desired. When sofa bed 20 is to be used as a bed such as seen in FIG. 4, seat cushions 22 are removed, folded mattress and pillow top combination 10 in frame 25 can be extracted as usual from sofa bed 20 and used in a bed mode for sleeping purposes. The process of converting sofa bed 20 from the sofa mode to the bed mode can be repeated as often as necessary without damage to the fasteners employed or to mattress and pillow top combination 10 due to the wide spacing along fold spaces 15, 16 as shown in FIG. 1.

The illustrations and examples provided herein are for explanatory purposes and are not intended to limit the scope of the appended claims.

I claim:

1. A foldable mattress comprising: a top surface, a bottom surface, said top surface joined to said bottom surface, a U-shaped mattress first fastener half, a U-shaped mattress second fastener half, said mattress first and second fastener halves attached to said mattress top surface, said mattress first and second fastener halves positioned in opposing relation, a foldable pillow top, a first pillow top fastener half, said first pillow top fastener half attached to said pillow top, said first pillow top fastener half for engaging said mattress first fastener half to releasably attach said pillow top to said mattress, said mattress first and second fastener halves spaced to form a lateral gap along said mattress top surface and to allow said mattress and said pillow top to fold therealong without interference from or damage to said mattress first and second fastener halves or to said first pillow top fastener half.

2. The foldable mattress of claim 1 wherein said U-shaped mattress second fastener half has a length shorter than said mattress first fastener half.

3. The foldable mattress of claim 2 further comprising a second pillow top fastener half, said second pillow top fastener half attached to said pillow top in opposing relation to said first pillow top fastener half and spaced to form a lateral gap along said pillow top and to allow said mattress and said pillow top to fold without interference from or damage to said second pillow top fastener half, said second pillow top fastener half for engaging said mattress second fastener half, said second pillow top fastener half having a length shorter than said first pillow top fastener half.

4. The foldable mattress of claim 1 further comprising a pair of sides and a pair of ends, said pair of sides each joined to each of said pair of ends.

5. The foldable mattress of claim 1 wherein said mattress first fastener half comprises a zipper half.

6. The foldable mattress of claim 1 wherein said pillow top has a thickness less than said mattress thickness.

7. A mattress with a removable pillow top comprising:

a) a foldable mattress, said foldable mattress comprising a top surface, a mattress first pair of U-shaped fastener halves, said mattress first pair of fastener halves attached to said mattress top surface, said mattress first pair of fastener halves longitudinally spaced apart in opposing relation and positioned inward from said top surface edge; and b) a foldable pillow top, said foldable pillow top comprising a bottom surface, a first pair of U-shaped pillow top fastener halves, said first pair of pillow top fastener halves attached to said pillow top bottom surface, said first pair of pillow top fastener halves longitudinally spaced apart in opposing relation and positioned inward from said pillow top edge, each of said first pair of pillow top fastener halves for engaging different ones of said mattress first pair of fastener halves for removably attaching said foldable pillow top to said foldable mattress.

8. The mattress with a removable pillow top of claim 7 wherein said foldable pillow top comprises a flexible material.

9. The mattress with a removable pillow top of claim 7 wherein said first pair of mattress fastener halves and said first pair of pillow top fastener halves each comprise zipper halves.

10. A method of forming a foldable mattress with a removable pillow top for use in a foldable bed comprising the steps of:

a) providing a foldable mattress and a removable foldable pillow top, the mattress having a pair of fastener halves attached to a top and spaced to define a lateral fold space therealong, the pillow top having a pair of fastener halves attached to a bottom and spaced to define a lateral fold space therealong, the pillow top fastener halves for engaging the mattress fastener halves; and b) engaging the mattress fastener halves with the pillow top fastener halves to attach the pillow top to the mattress with the mattress defined fold space in contact with the pillow top defined fold space to allow the mattress and attached pillow top to fold without interference from or damage to the mattress fastener halves or to the pillow top fastener halves.

11. The method of claim 10 wherein providing a pair of mattress fastener halves and a pair of pillow top fastener halves comprises the step of providing a pair of opposing mattress zipper halves and a pair of opposing pillow top zipper halves.

12. The method of claim 10 further comprising the step of folding the mattress and attached pillow top simultaneously along the mattress defined fold space and pillow top defined fold space.

13. The method of claim 12 further comprising the step of inserting the folded mattress and attached pillow top in a sofa bed frame.

14. The method of claim 13 further comprising the step of removing the mattress and attached pillow top from the sofa bed frame.

15. The method of claim 14 further comprising the step of unfolding the folded mattress and attached pillow top simultaneously.

16. The method of claim 15 further comprising the step of removing the attached pillow top from the mattress by disengaging the pillow top fastener halves from the mattress fastener halves.

* * * * *